United States Patent [19]

Breen

[11] Patent Number: 4,614,367

[45] Date of Patent: Sep. 30, 1986

[54] TAMPER-RESISTING MULTIPART NEGOTIABLE INSTRUMENTS

[75] Inventor: Thomas J. Breen, Arlington Heights, Ill.

[73] Assignee: Rand McNally & Co., Skokie, Ill.

[21] Appl. No.: 683,961

[22] Filed: Dec. 20, 1984

Related U.S. Application Data

[63] Continuation of Ser. No. 389,216, Jun. 17, 1982.

[51] Int. Cl.[4] ..... B42D 15/00; B41L 1/00; B41M 5/02; B41M 5/00

[52] U.S. Cl. ..... 283/102; 282/28 R; 427/153; 428/915

[58] Field of Search ..... 282/28 R, 27 R, 11.5 A; 427/153; 428/915, 916; 283/102

[56] References Cited

U.S. PATENT DOCUMENTS

| | | | |
|---|---|---|---|
| 2,333,979 | 11/1943 | Bradt | 428/915 |
| 3,623,944 | 11/1971 | Davis | 428/915 |
| 3,635,747 | 1/1972 | Skees | 282/28 R |
| 3,837,888 | 9/1974 | Hoffman et al. | 282/28 R |
| 4,010,292 | 3/1977 | Shackle et al. | 427/153 |
| 4,092,456 | 5/1978 | Newman et al. | 427/153 |
| 4,098,947 | 7/1978 | Schmidt et al. | 427/153 |
| 4,111,734 | 9/1978 | Rosenfeld | 428/207 |
| 4,143,891 | 3/1979 | Neubauer | 427/153 |
| 4,178,598 | 12/1979 | Erlichman | 427/153 |
| 4,239,832 | 12/1980 | Barouh et al. | 428/915 |

FOREIGN PATENT DOCUMENTS

| | | | |
|---|---|---|---|
| 1435686 | 5/1976 | United Kingdom | 428/915 |

*Primary Examiner*—Paul A. Bell
*Assistant Examiner*—Paul M. Heyrana, Sr.
*Attorney, Agent, or Firm*—Dressler, Goldsmith, Shore, Sutker & Milnamow, Ltd.

[57] ABSTRACT

Improvements in tamper-resisting multipart negotiable instruments, such as airline ticket books are disclosed. The books include at least two webs. The first web includes, on its second surface, a medium for transferring an image to the first surface of a second web in contact therewith when a corresponding image is inscribed on the first surface of that web. The first surface of the second web is in contact with the second surface of the first web and includes an image receiving layer capable of receiving an image transferred from the second surface of the first web. The image receiving layer includes a particulate mixture erasably bonded to the second web, which becomes defaced when rubbed with an organic solvent, and which is removable when an adhesive tape is applied to the image receiving layer and is pulled away therefrom.

23 Claims, 2 Drawing Figures

FIG. 1
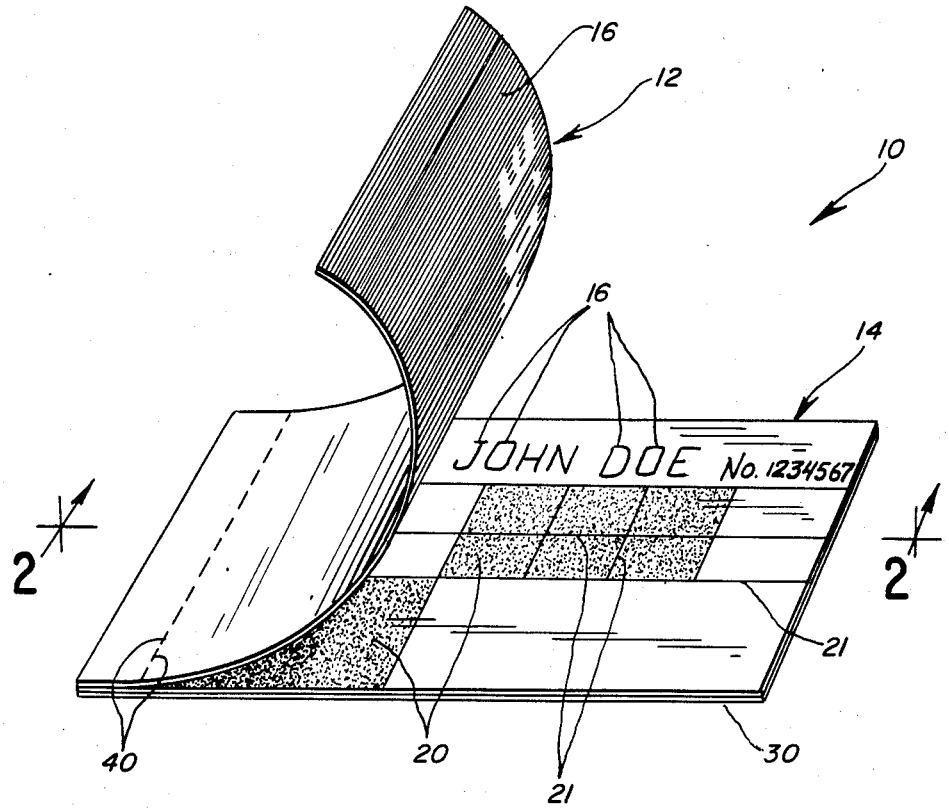
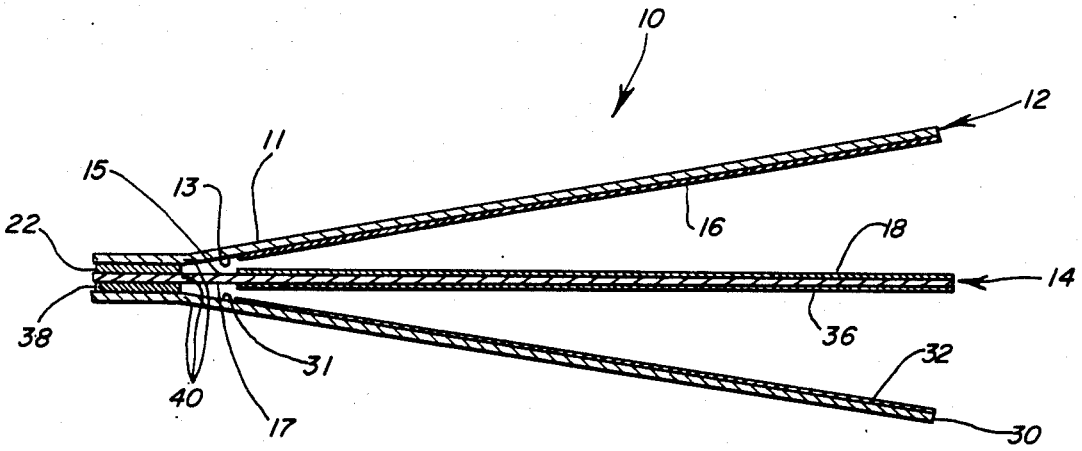
FIG. 2

TAMPER-RESISTING MULTIPART NEGOTIABLE INSTRUMENTS

This application is a continuation, of application Ser. No. 389,216, filed June 17, 1982.

DESCRIPTION

1. Technical Field

This invention relates to multipart negotiable instruments that are resistant to tampering, and particularly to multipart airline ticket books whose tickets, once filled out, resist subsequent tampering.

2. Background Art

Tampering with multipart negotiable instruments, such as checks, drafts, and tickets, such as airline tickets, by altering the amounts or destinations, or other information causes great monetary losses to the enterprises issuing them. Although various proposals have been made to alleviate this problem, they have not been entirely successful.

For example, a pattern is often printed as a background for the form in the hope that any tamperer will deface that background pattern when altering the issued form. However, such patterns have not been found completely suitable because they can be duplicated after the alteration, or are not sufficiently removable, so that when the multipart instrument is altered the images on the instrument can be altered without disturbing the printed background pattern whether by erasure, with a solvent, or by lifting with adhesive tape.

The negotiable documents disclosed in U.S. Pat. No. 4,143,891 attempt to solve the post-issuance alteration problem by causing a transferred ink to impregnate the fibers of the negotiable sheet. The system used in this patent uses a so-called "hot spot carbon" on the back of one sheet and a microencapsulated dye attractor and intensifier on the second sheet that is in contact with the back of the first sheet. Two potential problems with the system of this patent are the cost of the microencapsulated agents, and the fact that solvents or ink irradicators may be used to remove the transferred image after it is made.

Another attempt to produce tamper-resistant forms is disclosed in U.S. Pat. No. 4,051,295. In this patent, the form is made from thermoplastic polymer fibers that are heat and pressure bonded together. Those bounded fibers are then swollen in a solvent so that once an image is placed upon the swollen surface, attempted erasure of the image leaves a visible indication of abrasion. The system of this patent does not touch upon possible alteration by solvents or irradicators nor by lifting of the transferred image with tape, and is also relatively expensive to produce.

U.S. Pat. No. 4,092,449 discloses another system that attempts to foil tampering with credit cards. Here, an opaque plastic sheet is covered over with an invalidating layer of information which is in turn printed over with an erasable, opaque coating, such as a single layer of metallic coating or two or more layers of a conventional, opaque ink to which driers are added. A positive image is then written or printed upon the erasable coating so that the written or printed positive image also forms a negative, depressed, image in the erasable layer. The tamper resistance of this card is said to stem from the erasibility of the image-bearing coating and the formation of the negative image in that coating.

While one might notice tampering by erasure, were the system of U.S. Pat. No. 4,092,449 to be used for an airline ticket or other multipart negotiable instrument bearing images of relatively small sizes, the difference in depth caused by solvent removal of the smaller writing on a ticket would be difficult to notice, such as with the number of tickets a ticket agent must quickly handle for each airplane load of people. In addition, removal of the positive image by solvent, irradicator or lifting with tape would also be difficult to perceive.

Thus, the art does not supply a fully satisfactory means for readily identifying and therefore resisting tampering with the images on multipart negotiable instruments such as airline tickets.

SUMMARY OF THE INVENTION

According to the present invention, multipart negotiable instruments are prepared that have improved resistance to tampering after images are applied thereto. In one embodiment, the instrument is comprised of at least a first and a second generally planar web, each web defining a first and a second surface. The second surface of the first web includes a means for transferring an image to a surface in contact therewith when a corresponding image is inscribed upon the first surface of the first web.

The second web is secured in stacked relation to the first web and its first surface is in contact with the second surface of the first web. The first surface of the second web includes a layer for receiving an image that is in register with at least a portion of the image transferring means of the first web, and which is capable of receiving an image from the image transferring means of the first web when a corresponding image is inscribed on the first surface of the first web. The image receiving layer comprises a particulate matrix that is erasably bonded to the second web and is defaced when rubbed with organic solvent. The image receiving layer is also readily removable when a adhesive coated tape having a bond strength to steel of at least about 5 ounces per linear inch is bonded to the sheet and then removed and then pulled away.

The multipart instruments of this invention can be prepared by providing a first, generally planar web defining a first and a second surface. A material for transferring images is applied as a coating to the second surface of the first web to form an image transferring means. The transferring material is applied in an amount sufficient to transfer an image corresponding to one that is inscribed upon the first surface of that web to an image receiving layer on a second web in contact with the second surface of the first web.

A second, generally planar web defining a first and a second surface is also provided. A coating or image receiving layer comprised of a particulate matrix erasably bonded to the web is applied to the first surface of the second web. The image receiving layer is defaced when rubbed with an organic solvent and is also removable when a adhesive coated tape having a bond strength of 5 ounces per linear inch is affixed to it and then pulled away.

The first and second webs are secured together in a stacked relation so that at least a portion of the image transferring means on the second surface of the first web is in contact and in register with at least a portion of the image receiving layer on the first surface of the second web.

The present invention and its use have several benefits and advantages. One advantage is that tamper-resisting business multipart negotiable instruments and tickets can be prepared relatively inexpensively.

Another advantage is that both images formed on the image receiving layer and the image receiving layer itself are substantially removed by erasure, due to the erasable bonding of the image receiving layer to its web.

Still another advantage of the present invention is that the transferred image and the image receiving layer are defaced when alterations to a filled out multipart ticket are attempted by contact and light rubbing with organic solvents.

Yet another benefit of the present invention is that the image receiving layer is removable with adhesive coated tapes, thereby also lessening the possibility of successful tampering with a ticket once it is filled out and issued by that means.

A further benefit of the present invention is that the image receiving layer is defaced by contact and light rubbing in the presence of water, again lessening the possibility of successful tampering.

An additional benefit of the present invention is that its temper-resisting qualities can be utilized in conjunction with printed patterns and designs that are frequently employed in negotiable instruments to thereby obtain the benefits of both types of protection.

Still further advantages and benefits from this invention will be readily apparent to those skilled in the art from the description of the invention that follows and embodiments thereof, from the claims and from the accompanying drawings.

BRIEF DESCRIPTION OF THE DRAWINGS

In the accompanying drawings forming part of the specification, and in which like numerals are employed to designate like parts throughout the same, FIG. 1 is a perspective view of a presently preferred embodiment of a multipart ticket of this invention having one web partially folded backward; and FIG. 2 is an enlarged sectional view of the embodiment of FIG. 1 shown, for ease of illustration, in a partially opened position, taken along line 2—2.

DETAILED DESCRIPTION

This invention can be practiced and used in many different forms. The specification and the accompanying drawings disclose a specific example of the invention and the invention is not intended to be limited to the specific example illustrated.

For ease of description, the embodiments of the invention will be described in a normal position of use, and terms such as upper, lower, contact, register and stacked relation, and the like will be used with reference to the normal position of use. It will be understood, however, that the multipart negotiable instruments or tickets of this invention can be manufactured, stored, transported, sold and used in other orientations.

FIG. 1 illustrates a multipart negotiable instrument such as a book 10 of airline tickets. Although the further description of the present invention will be made with regard to books of airline tickets, it is apparent that the principles and subject matter disclosed are equally applicable to other multipart negotiable instruments, such as checks, drafts, train and bus tickets, and the like, wherein multiple copies are desired to be prepared from an original without the use of mechanical copying equipment, and particularly where tampering with one or more of the multiple copies is a problem to be anticipated.

Referring to FIG. 2, the book of blank tickets according to this invention contains at least two sheets or webs, namely an upper or first web 12 defining a first surface 11 and a second surface 13 bearing image transferring means 16 thereupon. The second web 14 of the book defines a first surface 15 and a second surface 17. The first surface 15 of the second web 14 includes an image receiving layer 18 disposed thereon and covering at least a selected portion of the first surface 15 of that web. In preferred practice, the image receiving layer 18 may be subdivided into selected zones 20 in which images may be received. Zones 20 are preferably defined by lines or other indicia 21 printed over or under the image receiving layer 18. The first web 12 and the second web 14 are secured to each other to form the book of ticket blanks by any convenient means such as by adhesive 22.

In preferred practice, at least the web 14 is removable along a line of perforations 40. Some or all of the remaining webs within the book can be similarly removable.

A book 10 of ticket blanks may contain more than two webs, as is illustrated in FIG. 2. In this instance, central web 14 includes an image receiving layer 18 on its first surface 15 and also includes an image transferring means 36 disposed upon its second surface 17. Here, an additional, third web 30 having an image receiving layer 32 disposed upon its first surface 31 and zones for receiving images defined by indicia printed over the image receiving layer 32 is placed under the second web in stacked, contacting and registered relation thereto, in the same manner in which the second web was placed under the first web. The third web 30 or additional webs (not shown) are also preferably secured in the ticket book as by adhesive means 38, and are made detachable therefrom, as by perforations 40.

The webs of the books 10 can be made from various papers and sythetic fibers as are known in the art for the preparation of tickets and other multipart negotiable instruments. In preferred practice, the webs are paper and the surfaces of the paper are hardened and smoothened as desired with conventional sizings and/or by calendering. The hardening assists in retarding of penetration of the various layers that are subsequently applied to the surfaces of the webs.

The smoothness of the preferred paper webs can differ from one surface of the web to the other, and can be specified in units of microinches by a surface smoothness indicator in accordance with the standard paper industry smoothness measurements. Thus, in preferred practice, both surfaces may have a smoothness of about 35 microinches to about 100 microinches. In more preferred practice, the paper web surface that includes the image transferring means may have a surface smoothness of about 50 microinches to about 85 microinches, while the surface of the paper bearing the image receiving layer may have a surface smothness of about 60 to about 95 microinches. Surface smoothness can be measured by a Gould SURFANALYZER 7100 model 21-01200-00 manufactured by Gould, Inc. of Rolling Meadows, Ill.

The image transferring means can be comprised of any one of a number of well-known transferring agents. The important feature of the image transferring means is that it transfer an image to the image receiving layer when those layers are in contact with each other and a corresponding image is inscribed as by writing with a ballpoint pen, pencil, or by typewriter upon the first surface of the web that includes the image transferring means or on a surface or web that overlies the web bearing the image transferring means.

The word "inscribed" in its various grammatical forms is used herein to mean a sufficient amount of pressure is applied directly or indirectly to the first surface 11 of the web 12 bearing the image transferring means 16 so that an image corresponding to the image inscribed can be transferred to the image receiving layer. The normal pressures used in writing with ball point pen, pencil or typewriter are sufficient for that inscribing.

Included among the suitable materials comprising the means for transferring images to the image receiving layer of the web 14, are commonly used carbon-containing coatings, and microencapsulated inks. Thus, substantially any material that can be transferred by inscription from one surface and be retained upon the image receiving layer is suitable.

In preferred practice, the image transferring means is comprised of a colorant-medium dispersion; i.e., a colorant, such as a dye or pigment, dispersed in a hydrophobic medium. Suitable colorants include barium lithol, carbon black and methylviolet oleate. Suitable hydrophobic media include carnauba wax, beeswax and paraffin waxes, and the like, or mixtures thereof. The waxes can be used alone as well as in combination with naturally occurring and synthetic oils, such as mineral oil, which serve to plasticize or soften the waxes. In addition, fillers such as kaolin, petrolite, and the like may also be present in the colorant-medium dispersion.

The hardness of the image transferring means in relation to the hardness of the image receiving layer also plays a role in that the surface of the image transferring layer should be softer than the surface of the image receiving layer as used on its web.

Generally, the hardness of the final image transferring means can be pretested by making a penetrometer determination upon a block or other flat-surfaced shape of the material comprising the image transferring means. In preferred practice, the image transferring material exhibits a penetrometer reading (in units of 0.1 millimeter), of more than about 5 and less than about 30 units. In more preferred practice the penetrometer reading is about 10 to about 20 units. In most preferred practice, penetrometer readings are about 14 to about 18 units. A Universal Penetrometer with 50 gram applied load for a total load of 100 grams, and a dwell time of about 5 seconds is used for these measurements.

Another way to compare the relative hardnesses of the image transferring material and the image receiving layer is by the effect of attempts to write upon each surface, as coated and dried upon their respective webs, using pencil "leads" of different degrees of hardness.

Using pencil leads having a diameter of 0.5 millimeters and a usual writing pressure, a preferred image transferring means is scratched, and removed, but not written upon by a lead having a hardness of at least about B; i.e., by leads having a hardness of B, HB, H and harder. A 2B pencil lead also scratches the surface of a preferred image transferring means, but transfers some of the lead to the transferring means. Thus, the surface of a preferred image transferring layer is scratched and removed by writing thereon with a pencil lead having a hardness of at least 2B.

Similarly, the coated and dried surface of the image receiving layer is written upon by pencil leads having a hardness of at least up to 6H. The surface of the image receiving layer is therefore harder than a 6H pencil lead.

The image transferring material is applied as a coating to at least a portion of the desired web surface by coating methods known in the art, such as from a solvent dispersion or a melt, to form the image transferring means. The coating is suitably applied to the web surface in an amount to provide an image transferring layer at about 0.8 to about 4 pounds per ream of 20 inch by 30 inch paper, after drying. In preferred practice, the image transferring material is applied to the paper in an amount of about 1 to about 2.5 pounds per ream, and more preferably at about 1.1 to about 2.0 pounds per ream.

The image receiving layers 18 and 32 of webs 14 and 30 comprise a particulate matrix. The particulate matrix can itself be comprised of a number of solid materials that are insoluble or substantially insoluble in water and organic solvents. Exemplary particulate matrix materials include usual inorganic pigments and fillers such as titanium dioxide, zinc oxide, silica, calcium carbonate, calcium sulfate and the like, and mixtures thereof. The choice of fillers can be made to vary the opacity of the ultimately formed image receiving layer from being opaque to translucent, as is known in the art.

The particles are ground to a fine consistency so that they can be preferably printed flexographically upon the surface of the desired web. A useful average particle size is about 15 to about 60 microns in the largest dimension. Preferably, the average particle size is about 5 to about 6 using the North Standard measurements of particle size which correspond to particles having an average largest dimension of about 25 to about 40 microns.

The particulate matrix is erasably bonded to the desired web in preferred practice by organic polymer that can be soluble or dispensible in organic solvent or in water, or mixtures thereof. Exemplary organic polymers include polyvinyl butyral resin, acrylic ester homopolymers and copolymers, such as those of acrylic acid and methacrylic acid esters of $C_1$–$C_8$ alcohols polymerized with themselves, as well as with other monomers such as styrene, acrylic acid, methacrylic acid, maleic acid, acrylamide, methacrylamide and N-substituted $C_1$–$C_8$ derivatives thereof. As is known in the latex paint art, polymers that contain acidic groups can be made water soluble or dispersible by neutralization of the acid groups with a base such as sodium hydroxide, amines such as ammonia or ethanolamine and the like. In addition, water solubility and dispersibility can also be improved by copolymerization of monomers that contain hydroxyl groups such as Z-hydroxyethyl acrylate or N-(2-hydroxyethyl) methacrylamide.

Polyvinyl butyral resins are particularly preferred.

The image receiving layer can be applied to the web by lithographic, gravure, flexography, or the like.

In preferred practice, the weight ratio of the organic solvent-soluble polymer to that of the particulate matrix in the flexagraphic-type ink is about 1:3 to about 1:5.

It is preferred that the polymer be dissolved or dispersed in an organic solvent and the phrase "organic solvent" will be used illustratively hereinafter with the understanding that water, admixtures of water and an organic solvent are also useful. The word "soluble" will be used for convenience hereafter to include materials that are either soluble or dispersible.

As noted above, the image receiving layer is preferably flexographically printed onto the desired web. To that end, the particulate matrix and bonding polymer are dispersed and/or dissolved in a suitable solvent to form a flexographic-type ink.

The phrase "organic solvent" is used herein to include usual liquid solvents of low molecular weight (less than about 250 Daltons). Typically useful organic solvents include hydrocarbon solvents such as hexane and benzene, ketones such as acetone and methyl ethyl ketone, esters, such as ethyl acetate and butyl acetate, chlorocarbons such as trichloroethylene, trichloroethane and chloroform, as well as alcohols such as methanol, ethanol, and the like. In addition, mixed organic solvents, such as lacquer thinner and mineral spirits, as well as mixtures of the above solvents fall within the definition "organic solvent" as used herein. A particularly preferred organic solvent is ethanol.

The organic solvent is preferably used in a volume, which if anhydrous ethanol, would comprise about 40 to about 60 weight percent of the total flexographic-type ink used for making the image receiving layer coating. More preferably, the volume of organic solvent comprises about 45 to about 55 weight percent of the flexographic-type ink, as anhydrous ethanol.

The amounts of the above ingredients comprising the flexographic-type ink used to prepare the image receiving layer are easily adjusted to provide a coating, after drying at 150° F., of about 1.25 to about 1.55 pounds per ream of paper, the paper again being 20 inches by 30 inches. In more preferred practice, the amount of image receiving layer after drying is about 1.3 to about 1.45 pounds per ream calculated upon the area of the web covered with the layer. That desired amount is typically obtainable from a composition that has a viscosity using Zahn No. 2 conditions at 70° F. (21° C.) of about 50 to about 65 seconds.

It is noted that the image receiving layer need not cover the entire surface of the web which it is applied. In preferred practice, the image receiving layer covers at least a portion of the first surface of the web, e.g. for tickets, that portion containing points of origin and destination as well as the area wherein the cost of the trip is inscribed.

After drying, the image receiving layer so produced may be defaced and also stained by light, fingertip rubbing with organic solvents. The layer also demonstrates defacement when liquid water is lightly rubbed upon its surface, although the layer is preferably somewhat less sensitive to water than to organic solvents to permit ease of usage under conditions of high relative humidity. The layer is removed when rubbed with a pencil eraser.

The image receiving layer is also removable from the web surface when an adhesive tape having a bond strength to steel of about 5 ounces per linear inch (about 5.5 Newtons per 100 millimeters) is applied and then pulled away therefrom under the conditions of Federal Test Method Standard 147c. (Substantial removal of the image receiving layer can be effected by an adhesive tape having a bond strength to steel of about 6 ounces per foot (about 7 Newtons per 100 millimeters) and subsequent pulling of the tape away from the surface of the image receiving layer, using the above test conditions.

In addition, the image receiving layer is more readily removable from the web than are images transferred to or through the image receiving layer by inscription.

When less than the selected amounts of the image receiving material is applied to the web surface, easy visual perception of erasure in the image receiving zone tends to be lost. When greater than the selected amount of the image receiving material is applied to the desired surface, the image receiving layer tends to crack or flake off prematurely, and much of the flexibility of the image receiving layer is lost.

The image receiving layer is also capable of receiving images written or inscribed directly thereon, as by ballpoint, fountain or "felt-tip" pens, pencils, crayons and the like.

As noted previously, the first surface of the web including the image receiving layer may define zones wherein the images are received. Those zones 20 are defined by indicia 21 applied at least in part over or under the image receiving layer. The indicia 21 can be so applied by conventional printing techniques such as offset and lithographic printing, using standard printing inks. When indicia 21 are printed over the image receiving layer, those indicia are also removed by erasure and when a tape is applied to the surface of the layer and then pulled off slowly. When the indicia 21 are printed under the image receiving layer, it is preferred to use a translucent image receiving layer and an opaque ink for the indicia so that the zones 20 for receiving images are clearly deliniated.

The web surfaces can additionally be printed or marked with designs or patterns as are frequently used to help impart temper resistance to negotiable instruments. Such additional printing or marking is traditionally accomplished with so-called "security" inks, and the image receiving layer inks utilized herein can also be used for this purpose. When inks used for the image receiving layer are utilized in making additional designs or patterns on a web surface, the erasability, defacement with solvents and tape pull-away features of the image receiving layer are also imparted to the additional designs or patterns. The designs or patters can be made under or over the image receiving layer and can be of the same color as that layer or of a different color.

A book of ticket blanks, can be prepared that contains a plurality of webs similar to the second web 14 illustrated in FIG. 2. In addition, the ticket books 10 of this invention can utilize image transferring means and image receiving layers different from those described herein, as long as there is at least one web containing an image transferring means, as described before, which means is in contact and stacked relation with a surface of a second web, which second web surface includes the image receiving layer, as was also described before.

It is preferred that the portion of the web that underlies the image receiving layer be of a color that contrasts with the color of the image receiving layer and, also, preferably, contrasts with the color of the image transferring means. In most preferred practice, the image receiving layer and the web upon which it is coated also exhibit contrast when irradiated with ultraviolet light.

To prepare ticket blank book 10 of the instant invention, a first, generally planar web defining a first and a second surface is provided. The coating of image transfer means is thereafter applied to at least a selected portion of the second surface of that first web in an amount sufficient to transfer an image that is inscribed upon or against the first surface of that first web onto an image receiving layer on a second web in contact with the second surface of the first web.

A second generally planar web defining a first surface and a second surface is also provided. A coating of image receiving material is applied to at least a portion of the first surface of that second web, as by flexographic printing; that image receiving layer comprises the above described particulate matrix erasably bonded to that web surface.

The first and second webs are adhesively secured together in stacked relation so that at least a portion of the image transferring means on the second surface of the first web is in contact and in register with at least a portion of the image receiving layer on the first surface of the second web to thereby form the book of ticket blanks. The webs are preferably made removable from the book of ticket blanks by providing score lines in the webs at desired locations.

When ticket books of this invention comprise more than the minimum two webs described above, and at least some of those additional webs include both an image transferring means and an image receiving layer, it is preferred that the image receiving material be first coated on the web, and dried to the touch. Printing of indicia over the surface of the image receiving layer and thereby covering at least a portion of the image receiving layer follows thereafter, followed by coating the image transferring material on the other surface thereof. Any underprinting of the image receiving layer is accomplished prior to coating of the image receiving material.

The ticket blank books are used to provide improved resistance to tampering after the ticket or web of the form is issued. An image is inscribed upon one web, transferring the inscribed image from at least one transferring means to at least one image receiving layer on a second web in contact and in register therewith. The ticket containing the image so transferred is thereafter issued.

Best Mode For Carrying Out The Invention

EXAMPLE 1

Book of Airline Ticket Blanks

A book of airline ticket blanks of this invention was prepared from a white roll of calendered paper having a smoothness of about 80 microinches on one surface and a smoothness of about 60 microinches on the other surface. The image receiving layer was applied on a selected area on the 80 microinch surface by flexographically printing a dispersion of North Standard size 5–6 particles and polyvinyl butyral resin in organic solvent. The weight ratio of particles to copolymer to solvent was about 21:5:24, with the solvent comprising a mixture of ethanol and ethyl acetate in a weight ratio of about 13:1, respectively. The dispersion had a Zahn No. 2 viscosity of 57 seconds at 21° C. (about 70° F.). Total solids content of the dispersion was about 54 percent by weight and included small amounts of plasticizing oils. The image receiving layer was applied at an average generally uniform coverage of 1.3–1.45 pounds per ream, after drying at 150° F. A green ink sensitive to ultraviolet light was printed over the image receiving layer to provide, in this case, a yellow "fluorescent" color which contrasted with the dull violet emitted under ultraviolet light by the paper in the uncoated zones.

The surface bearing the image receiving layer was then further overprinted with lines to define zones for receiving images and with other airline ticket indicia. That printing was then dried.

A dispersion of barium lithol as colorant, carnauba wax and plasticizing oils as hydropholic medium was further dispersed in trichloroethylene, and thereafter applied on the surface of the above coated paper having a smoothness value of 60 microinches to provide the image transfer means. Penetrometer readings on blocks of the colorant-medium dispersion prior to further dispersion in trichloroethylene averaged 14 to 18. After drying, it was determined that the material of the image transferring means had been applied at an average generally uniform coverage in excess of 1 pound per ream.

After the material comprising the image transfering means had dried, the paper was perforated, and was cut into webs of the desired size, leaving about one-half inch between the perforations and the edge of the web.

Two types of additional webs cut to the same size as the above web were also prepared. The first additional web included perforations, printed lines and airline ticket indicia on one surface and the image transferring means, prepared as described before, on the other surface. The second additional web included perforations, and an image receiving layer, overprinted lines and airline ticket indicia on the same surface, applied as described before.

The individual webs were assembled in a stack with the image transferring means of each web in contact with the image receiving layer of the web below it and the printed lines of each web in register. The stack so made contained a web having an image transferring means but no image receiving layer as the top-most web, and a web having an image receiving layer but no image transferring means as the bottom-most web. Webs between the top-most web and the bottom-most webs included both an image transferring means and an image receiving layer. Adhesive was placed on the web portion between the perforations and the edge, and the individual webs were glued together to form the book of airline ticket blanks.

EXAMPLE 2

Tamper-Resistance Determinations

Sample ticket blanks prepared substantially as described in Example 1 were examined for resistance to tampering. The sample webs were conditioned at 73° F. and 50 percent relative humidity for 48 hours in a convection oven prior to making the examinations. The results were as follows:

| | Observations |
|---|---|
| Application Of The Indicated Material Followed By Light Rubbing With The Index Finger | |
| Ethanol, Lacquer Thinner Acetone, Toluene, Trichloroethane | The green printing smeared and defaced when wet; permanent stain on drying was observed. |
| Mineral Spirits | The green printing rubbed off when the layer was wet; permanent stain on drying was observed. |
| Iso-propanol | The green printing smeared and defaced when the layer was wet; permanent stain on drying was |

-continued

| | Observations |
|---|---|
| | observed. |
| Water, Soapy Water, Vinegar | Severe rub-off of printing; permanent stain on drying was observed. |
| Erasure By A Common Pencil Lead Eraser | Severe rub-off of green printing to the underlying white sized paper was observed, which was observable under ultraviolet light as a dull violet color contrasting with the brilliant yellow exhibited by the green zone. |
| Application Of Scotch Brand Adhesive Tape Over The Green Layer | When the layer was pulled off slowly, it removed the green layer and revealed the underlying white sized paper which was observable under ultraviolet light as a dull violet color contrasting with the brilliant yellow exhibited by the green zone. |

The foregoing results show (1) the solvents and chemicals commonly used to alter airline tickets severely defaced the ticket surface by permanent staining or smearing of the image receiving layer; (2) the stains and defaced areas were very visible as dull violet discolorations under ultra-violet light and frequently as white area by the naked eye, and (3) those physical properties provide readily discernible evidence to indicate that there was an attempt to alter the subject matter in the image receiving layer of the ticket.

Webs that would be useful for receiving transferred images in negotiable instruments were quantitatively compared for their resistance to successful tampering by means of erasure.

EXAMPLE 3

Quantitative Erasure Comparisons

Webs that are useful for receiving transferred images in negotiable instruments were quantitatively compared for their resistance to successful tampering by means of erasure.

Quantitative comparisons were made of the erasibility of commercially available, fugitive security inks and the image receiving layers, forming part of the present invention. The procedure used was based upon Technical Association of Pulp and Paper Industry (TAPPI) Procedure #T476 M-51, and was intended to simulate removal of the ink or receiving layer by abrasion similar to that produced by a gum eraser.

The inks and image receiving layers were printed on paper webs similar to those used in Example 1, and were dried prior to use. The paper used had a white sized coating beneath the ink or receiving layer. The commercial fugitive security ink was printed in the usual amount used for airline tickets while the image receiving layer was printed in an amount of about 1.25 to about 1.55 pounds per ream, after drying.

This comparison utilized a Taber Abraser, Model 505 turntable manufactured by Testing Machine, Inc. of Amityville, New York, onto which the printed sheets were mounted. The turntable was set to revolve at a speed of 65–75 revolutions per minute. A Calibrase Wheel (CS 10, medium) manufactured by Taber Instrument Corporation of North Tonawanda, New York, was set with its edge perpendicular to and contacting each mounted sheet with an effective weight on the sheet of 1000 grams. The loaded sheet was maintained in contact with each printed sheet for 15 revolutions of the sheet. The wheel rotates freely as the turntable rotates beneath it, causing a shearing action against the surface of the paper mounted on the turntable.

Reflectance values were measured with a Photovolt Reflectance Meter Model 670, manufactured by Photovolt Corporation of New York, New York. Reflectances were measured in units of photovolts percentage on the same sheet before and after abrasion to indicate relative amount of ink or image receiving layer removed. The results are shown in Table 1 below.

TABLE 1

| Ink | Reflectance in Photovolt Percentage | | |
|---|---|---|---|
| | Before Abrasion | After Abrasion | Percent Change |
| Comparative Erasures | | | |
| None | 74 | — | — |
| Image Receiving Layers | | | |
| Black | 8 | 30 | 275 |
| Blue | 44 | 55 | 25 |
| Commercial Fugitive Inks | | | |
| Light blue | 61 | 63 | 3 |
| Buff ink with black ink over screening | 50 | 51 | 2 |

The above results illustrate that relatively more of the interlying paper web is revealed to reflect the incident light when an image receiving layer of useful herein is abraded than when a commercially available fugitive security ink is similarly abraded. These results also illustrate that a negotiable instrument of this invention would show improved resistance to tampering when compared to a similar instrument made only from commercially available, fugitive security inks.

EXAMPLE 4

Quantitative Chemical Sensitivity Comparison

Webs that would be used to receive transferred images in negotiable instruments were again quantitatively compared for their relative resistance to successful tampering by means of rubbing with a liquid chemical.

Here, reflectances were compared for a commerically available, fugitive security ink and an image receiving layer useful herein, each of which was printed and dried on a white paper substrate and then rubbed under standardized conditions with a gauze cloth that was damp with a chemical liquid. The security inks and image receiving layer was printed as discussed in Example 3.

A Sutherland Ink Rub Tester (U.S. Pat. No. 2,734,375) manufactured by Brown Company of Kalamazoo, Michigan was used for these comparisons. The gauze utilzed to carry the solvent and rub over the printed surfaces was 20×12 mesh U.S.P. Type VII in a 1 inch by 2 inch by one-fourth inch pad. The gauze-covered block utilized for rubbing had an effective weight of 3 ounces per 2 square inches.

In carrying out the comparisons, the solvent dampened gauze pad was mounted to the block and inked to the Testor. The dried, printed sheets were placed under the block and gauze, and the tester was acutated to produce six strokes, each about 3 inches in length. Ten drops of each liquid were applied evenly over the gauze surface to dampen that surface for each comparison.

Reflectances before and after solvent rubbing were measured with the previously discussed Photovolt Reflection Meter Model 670.

This procedure is similar to that of TAPPI Test Procedure T 478 SM-52, revised for use with liquid chemicals, with the gauze pad and block replacing the usually used "sled". The results of these comparisons are shown below in Table II.

TABLE II

| | Comparative Chemical Sensitivity | |
|---|---|---|
| | Reflectance in Photovolt, Percentage | |
| | Image Receiving Layer* | Commercial Fugitive Ink* |
| Solvent | | |
| None (initial reading) | 52 | 53 |
| Toluene | 73 | 58 |
| Benzene | 73 | 62 |
| Acetone | 72 | 58 |
| Toluol | 72 | 64 |
| Xylene | 71 | 65 |
| Methyl ethyl Ketone | 71 | 57 |
| Ink eradicator | 62 | 66 |
| Substrate | | |
| White, Unprinted | 74 | 74 |
| Black, printed | 6 | 6 |

*Both the receiving layer and ink were initially about the same color and intensity of blue.

In this comparison, the color of the printed surfaces generally went from blue to white for the image receiving layer and from blue to lighter blue for the commercially availabe security ink. Thus, after rubbing, reflectances for the image receiving layer-coated sheets are substantially that of uncoated paper, while reflectances after rubbing the commerical fugitive ink were generally much further from the value of 74 photovolts percent of the unprinted, white substrate.

The image receiving layer exhibited an average change of about 36 percent in reflectance while the commercially available, fugitive security ink showed an average of only about 16 percent in this comparison. These results further illustrate how negotiabe instruments of this invention have improved resistance to tampering.

Results using the ink eradicator indicated that the underlying paper web was destroyed before either the image receiving layer or the fugitive ink were removed. A separate determination showed that the underlying paper was also removed prior to removal of an image transferred to either the image receiving layer or the fugitive ink.

From the foregoing, it will be observed that numerous variations and modifications can be effected without departing from the true spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

What is claimed is:

1. A multipart negotiable instrument having improved resistance to tampering after inscription of an image thereon, said instrument comprising at least a first generally planner web and a second generally planar web, said first web defining a first surface and a second surface, said second surface including means for transferring an image to a surface in contact with the image-transferring means when a corresponding image in inscribed upon the first surface of said first web;

said second web being secured to said first web in stacked relation therewith, and defining a first surface and a second surface, said first surface being in contact with the second surface of said first web, the first surface of said second web being imprinted in selected zones and not in other zones with an image receiving layer which is erasably bonded in said selected zones to said first surface, said image receiving layer being a particulate matrix comprising particulate materials and a binder, said image receiving layer also being in register with at least a portion of said image transferring means of said first web and capable of receiving on the surface of said image receiving layer an image from said image transferring means when a corresponding image is inscribed against the first surface of said first web;

said image receiving layer being so erasably bonded to the second web that when an image is transferred onto the surface of said image receiving layer from said image transferring means said image remains on said surface of said image receiving layer and when an effort is made to erase it or remove it with an organic solvent, the image receiving layer and image are removed in the zone of erasure and the image receiving layer and image are defaced in the zone of attempted removal with organic solvent.

2. A multipart negotiable instrument in accordance with claim 1, and further comprising a pattern imprinted over said image receiving layer, such that when a portion of said image receiving layer is removed, an overlying corresponding portion of said pattern in removed.

3. A multipart negotiable instrument in accordance with claim 1, and wherein said particulate matrix comprises a polyvinyl butyral resin and a particulate filler.

4. A multipart negotiable instrument in accordance with claim 3, and wherein said image receiving layer is imprinted on said second web in an amount of aobut 1.25 to 1.55 pounds per ream.

5. A multipart negotiable instrument in accordance with claim 3, and wherein said image transferring means comprises a wax, and said webs are of paper having surface smoothnesses of from about 35 to about 100 microinches.

6. A multipart negotiable instrument in accordance with claim 1, and further comprising a pattern at least in said selected zones imprinted over said image receiving layer, such that when a portion of said image receiving layer is removed, an overlying corresponding portion of said imprinted pattern is removed.

7. A book of ticket blanks containing at least one, first paper web for transferring images to a ticket blank having improved resistance to tampering, and at least one, second paper web defining a ticket blank having improved resistance to tampering, said first and second paper webs being secured within the book in stacked, registered relation;

said first paper web defining a first surface and a second surface, said second surface of said first paper web including an image transferring means;

the second paper web being generally planar, removably secured within said book and defining a first surface and a second surface;

the first surface of said second paper web being imprinted in selected zones only with an image receiving layer capable of receiving an image transferred from said first paper web when a corresponding image is inscribed upon the first surface of said first paper web, said image receiving layer being erasably bonded in said selected zones to said first surface, said image receiving layer being a particulate matrix comprising particulate materials and an organic binder;

the first surface of said second paper web being imprinted with a pattern, said pattern being disposed at least in part in said selected zones;

said image transferring means comprising a colorant dispersed in a hydrophobic medium, the colorant-medium dispersion of the image transferring means having a penetrometer value of about 5 to about 30 when in the form of a block prior to formation of said means, said image transferring means for said first paper web and said image receiving layer of said second paper web being at least partially in contact and in register when an image is to be transferred therebetweeen;

said image receiving layer being so erasably bonded to the first surface of the second paper web by an organic polymer, that when an image is transferred onto the surface of said image receiving layer from said image transferring means said image remains on said surface of said image receiving layer and when an effort is made to erase it or remove it with an organic solvent, the image receiving layer and image are removed in the zone of erasure and the image receiving layer and image are defaced in the zone of attempted removal with organic solvent.

8. A book of ticket blanks in accordance with claim 7, and wherein said particulate matrix comprises a polyvinyl butyral resin and a particulate filler.

9. A book of ticket blanks in accordance with claim 8, and wherein said image receiving layer is imprinted on said second web in an amount of about 1.25 to 1.55 pounds per ream.

10. A book of ticket blanks in accordance with claim 8, and wherein said hydrophobic medium comprises a wax, and said web surfaces have smoothnesses of from about 35 to about 100 microinches.

11. A book of ticket blanks in accordance with claim 10, and wherein said book comprises a third web stacked below the second web, the second web having an image transferring means on its second surface, the third web having an image receiving layer on the surface confronting the second surface of the second web.

12. A book of ticket blanks in accordance with claim 7 wherein when an adhesive coated adhesive tape is applied to said image receiving layer and pulled away therefrom, said image receiving layer is removed, and wherein said adhesive tape has a bond strength to steel of at least about 5 ounces per linear inch.

13. A book of ticket blanks in accordance with claim 7 wherein the first paper web has an image transferring means on one surface, a second paper web has an image receiving layer on one surface and an image transferring means on its other surface, and a third paper web, said third web having an image receiving layer on a surface thereof.

14. A book of ticket blanks in accordance with claim 7, and further comprising a pattern wherein said pattern in said selected zones is imprinted over said image receiving layer, such that when a portion of said image receiving layer is removed, an overlying corresponding portion of said imprinted pattern is removed.

15. A method of preparing a multipart negotiable instrument having improved resistance to tampering comprising the steps of:

(a) providing a first, generally planar web defining a first surface and a second surface;

(b) applying a layer of a material for transferring an image on at least a portion of the second surface on the first web to form an image transferring means;

(c) providing a second, generally planar web defining a first surface and a second surface;

(d) imprinting a layer of an image receiving material to the first surface of the second web in selected zones thereof to form an image receiving layer capable of receiving an image transferred from said image transferring means when said means is in contact with said layer and a corresponding image is inscribed against the first surface of said first web, said image receiving layer comprising a particulate matrix erasably bonded to the first surface of the second web and defacable when rubbed with organic solvents, said layer being removable when a adhesive coated adhesive tape is applied to said image receiving layer and then pulled away therefrom;

(e) overprinting said first surface with a pattern at least in said selected zones; and (f) securing said first web and said second web together in stacked relation so that at least a portion of the image transferring means on said second surface of said first web is in contact and register with at least a portion of said image receiving layer on the first surface of said second web, whereby when an image is transferred onto the surface of said image receiving layer from said image transferring means said image remains on said surface of said image receiving layer and when an effort is made to erase or remove the image, at least a portion of the image receiving layer and of said pattern is moved with the image.

16. The method in accordance with claim 15, and wherein said particulate matrix comprises a polyvinyl butyral resin and a particulate filler.

17. The method in accordance with claim 16, and wherein said layer of image receiving material is imprinted on said second web in an amount of about 1.25 to 1.55 pounds per ream.

18. The method in accordance with claim 16, and wherein said layer of image transferring material comprises a wax, and said webs are of paper having surface smoothnesses of from about 35 to about 100 microinches.

19. The method in accordance with claim 18, and comprising the step of providing a third generally planar web stacked below the second web, providing the second web with a layer of image transferring material on its second surface, and the third web with an image receiving layer on its surface which confronts the second surface of the second web, and wherein when said first and second webs are secured together, they are secured together in stack relation with said third web.

20. A method of using a book of ticket blanks to provide improved resistance to tampering after a ticket in said book of ticket blanks is issued comprising the steps of:

(a) providing the book of ticket blanks containing at least one, first paper web for transferring images to a ticket blank having improved resistance tampering, and at least one, second paper web defining a ticket blank having improved resistance to tampering, said first and second paper webs being secured within the book in stacked, registered relation;

said first paper web defining a first surface and a second surface, said second surface of said first paper web including an image transferring means;

the second paper web being generally planar, removably secured within said book and defining a first surface and a second surface;

the first surface of said second paper web being at least in part imprinted in slected zones only with an image receiving layer capable of receiving an image transferred from said first paper web when a corresponding image is inscribed upon the first surface of said first paper web, said image receiving layer being erasably bonded in said selected zones to said first surface, said image receiving layer being a particulate matrix comprising particulate materials and an organic binder;

said image transferring means comprising a colorant dispersed in a hydrophobic medium, the colorant-medium dispersion of the image transferring means having a penetrometer value of about 5 to about 30 when in the form of a block prior to formation of said means, said image transferring means of said first paper web and said image receiving layer of said second paper web being at least partially in contact and in register when an image is to be transferred therebetween;

said image receiving layer being so erasably bonded to the first surface of the second paper web that when an image is transferred onto the surface of said image receiving layer from said image transferring means said image remains on the surface of said image receiving layer and when an effort is made to erase or remove it by rubbing with an organic solvent, the image receiving layer and image are removed in the zone of the erasure and the image receiving area is defaced in the zone of attempted removal with organic solvent;

(b) inscribing an image on the book of ticket blanks and transferring a corresponding image from at least the transferring means of the second surface of said first paper web to an image receiving layer on the first surface of said second paper web; and (c) issuing the book of ticket blanks containing the corresponding image so transferred.

21. The method in accordance with claim 20, and wherein said particulate matrix comprises a polyvinyl butyral resin and a particulate filler.

22. The method in accordance with claim 21, and wherein said web surfaces have a smoothness of from about 35 to about 100 microinches and said image receiving layer is imprinted in an amount of about 1.25 to 1.55 pounds per ream.

23. The method in accordance with claim 20, and wherein said pattern in said selected zones is imprinted over said image receiving layer, such that when a portion of said image receiving layer is removed, an overlying corresponding portion of said imprinted pattern is removed.

* * * * *